US012116156B2

(12) United States Patent
Herrmann

(10) Patent No.: US 12,116,156 B2
(45) Date of Patent: Oct. 15, 2024

(54) AUTOMATED RETAIL EDGE MARKER ACCUMULATION, COLLATION AND TRANSFER SYSTEM

(71) Applicant: Xerox Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 112 days.

(21) Appl. No.: 18/102,602

(22) Filed: Jan. 27, 2023

(65) Prior Publication Data

US 2024/0253838 A1 Aug. 1, 2024

(51) Int. Cl.

| | |
|---|---|
| ***B65H 39/04*** | (2006.01) |
| ***B65B 5/06*** | (2006.01) |
| ***B65B 13/02*** | (2006.01) |
| ***B65B 35/50*** | (2006.01) |
| ***B65H 31/30*** | (2006.01) |
| ***B65H 31/36*** | (2006.01) |

(52) U.S. Cl.

CPC ..... *B65B 35/50* (2013.01); *B65B 5/06* (2013.01); *B65B 13/02* (2013.01); *B65H 31/30* (2013.01); *B65H 31/36* (2013.01)

(58) Field of Classification Search

CPC .. B65H 31/24; B65H 31/3081; B65H 39/043; B65H 39/055; B65H 2301/42122; B65H 2301/4213; B65H 2301/4352

USPC ..... 270/52.16, 58.26, 58.29

See application file for complete search history.

(56) References Cited

U.S. PATENT DOCUMENTS

| | | | |
|---|---|---|---|
| 9,463,945 | B2 | 10/2016 | Herrmann |
| 9,463,946 | B2 | 10/2016 | Herrmann |
| 9,527,693 | B2 | 12/2016 | Herrmann |
| 10,968,068 | B1 | 4/2021 | Herrmann et al. |

*Primary Examiner* — Leslie A Nicholson, III

(74) *Attorney, Agent, or Firm* — Caesar Rivise, PC

(57) ABSTRACT

An automated packaging system for automated collating, stacking and transferring long cut retail edge marker strips exiting a roll fed high speed slitter/perforator/cutter apparatus includes a series of angled and stepped baffles configured to receive the cut retail edge marking strips and allow them to fall into and accumulate in bins formed by each angled baffle and then be removed from each bin consecutively by an automated pusher acting orthogonally to the bins to move and collate the retail edge markers into a final stack collated to meet a specific store planogram requirement. An automated transfer unit moves the final stack downstream for further packaging, which may include automated banding and loading of the final stack into an empty container for shipment to the store having the specific planogram requirement.

20 Claims, 15 Drawing Sheets

AUTOMATED RETAIL EDGE MARKER ACCUMULATION, COLLATION AND TRANSFER SYSTEM

FIELD OF DISCLOSURE

This invention relates generally to an automated collation system, and more particularly, to a collation system that automatically collects and collates retail edge marker strips destined for in-store shelves.

BACKGROUND

Retail stores often utilize edge markers to convey information regarding products offered for sale, e.g., product costs, unit cost, sale pricing, etc. Such markers must be updated and/or replaced on a periodic basis. For example, regular product pricing may change, or during a sale, a discounted price may be necessary. Changes to edge markers may be required for hundreds or even thousands of products and these changes may be required daily weekly or another periodic term. In addition, product placement may change which would require updating of the edge markers. In some states, it is critical that the edge markers be updated in a timely fashion as the retail store may be obligated to honor the price displayed adjacent the product. In other words, if the store fails to remove the edge marker that displays a discounted cost, the store must charge that cost if a customer relies upon that price when making a purchase selection. In view of the foregoing, it should be apparent that proper timing and placement of edge markers is a critical responsibility of a retail store.

Although some retail chain stores share common store layouts, also known as a store planogram, most retail locations, even within a chain store have unique store planograms. The changeover of store signage can incur significant time which in turn incurs significant cost. A common practice is to print sheets of edge marker strips and an employee or group of employees are tasked with edge marker changeover. These methods include various deficiencies, e.g. edge marker strips compiled out of order or not matched to the store planogram, sheets that require further separation of individual store departments, etc. These method are quite costly and presently, in at least one instance, requires for example, 20 people employed to individually catch and collate each sheet of edge markers. Other media collating systems including U.S. Pat. Nos. 9,463,945 B2, 9,463,946 B2 and 9,527,693 B2, are known, but the heretofore-mentioned problems persist.

Obviously, there is a need for a more efficient shelf edge marker collation system that presents shelf edge markers to store employees in a per store planogram order for in-store deployment. U.S. Pat. No. 10,968,068 B1 discloses such a system. Still it would be more beneficial to provide an automated solution for collating and processing the edge marker strips without constant manual intervention for subsequent shipping to a store.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a packaging system for automatically collating and transferring media strips exiting an upstream source. The packaging system includes a series of angled baffles with each of the series of angled baffles configured to include bins that receive the media strips longitudinally with each of the media strips extending over at least two of the series of angled baffles. The series of baffles includes an upstream angled baffle with each of the remainder of the series of baffles configured to cascade from the upstream baffle to eliminate media strip stub points while simultaneously providing a downward slope to enhance media strips sliding down the series of baffles. The packaging system also includes an automated pusher configured for automatic movement in a cross process direction to the media strips in response to detecting that the media strips have settled into the bins to shift the media strips in collated form from the bins to a first position and into a compiled collated stack in store planogram order, and a transport device configured to move the compiled collated stack of the media strips automatically from the first position to a second position downstream the first position in response to detecting a formation of the compiled collated stack for subsequent packaging of the compiled collated stack.

According to aspects illustrated herein, an exemplary packaging method for automatically collating and transferring media strips exiting an upstream source includes providing a plurality of angled baffles with each of the plurality of angled baffles configured to include bins that receive the media strips with each of the media strips extending over at least two of the plurality of angled baffles, feeding the media strips onto a longitudinal surface of the bins from the upstream source, wherein the series of baffles includes an upstream angled baffle with each of the remainder of the plurality of baffles configured to cascade from the upstream baffle to eliminate media strip stub points while simultaneously providing a downward slope to enhance media strip sliding down the plurality of baffles. The exemplary packaging method further includes providing an automated pusher configured for automatic movement orthogonally to the bins in response to detecting that the media strips have settled into the bins to shift the media strips in collated form from the bins to a first position and into a compiled collated stack in store planogram order, and providing a transport device configured to move the compiled collated stack of the media strips automatically from the first position to a second position downstream the first position in response to detecting a formation of the compiled collated stack for subsequent packaging of the compiled collated stack.

According to aspects described herein, an exemplary packaging device for automatically collating and transferring media strips exiting an upstream source includes a plurality of baffles, a stack platform, an automated pusher, and a transport device. Each of the plurality of baffles is configured to include a bin that receive the media strips longitudinally. The stack platform is laterally adjacent the plurality of baffles in the cross process direction. The automated pusher is configured for automatic movement in a cross process direction to the media strips in response to detecting that the media strips have settled into the bins to shift the media strips in collated form from the bins to a first position and into a compiled collated stack in store planogram order. The transport device is configured to move the compiled collated stack of the media strips automatically from the first position to a second position downstream the first position in response to detecting a formation of the compiled collated stack for subsequent packaging of the compiled collated stack.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
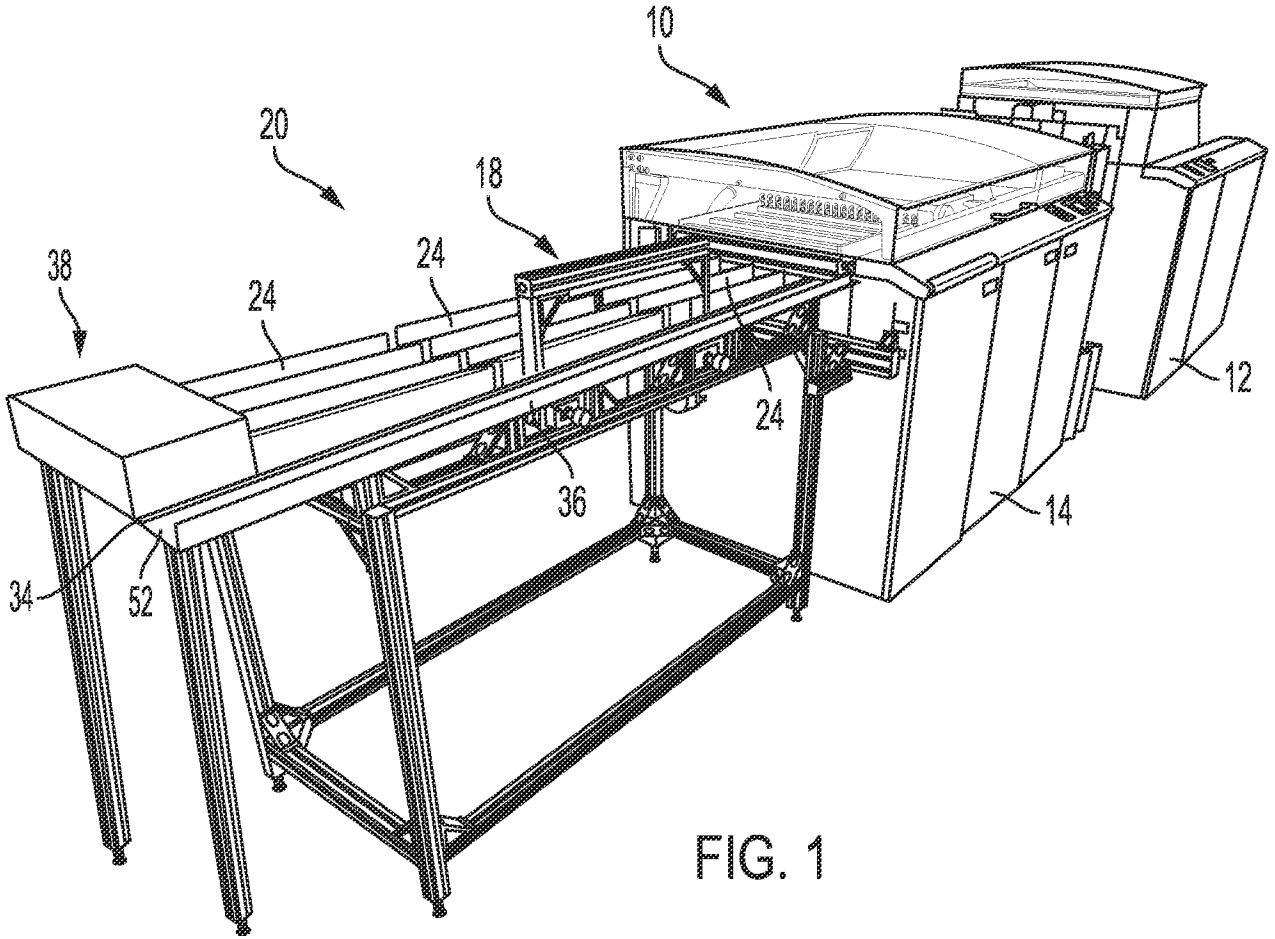
FIG. 1 is a partial perspective view of an automated packaging system connected to slitter and unwinder off-line processing system in accordance with examples of the embodiments.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatuses, and systems for automatically collecting, collating and transporting media strips (e.g. retail edge marker strips) destined for in-store shelves.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

Although embodiments of the invention are not limited in this regard, discussions utilizing terms such as, for example, "processing," "computing," "calculating," "determining," "using," "establishing", "analyzing", "checking", or the like, may refer to operation(s) and/or process(es) of a controller, computer, computing platform, computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Referring now to FIG. 1, there is shown an exemplary system 10 for outputting printed shelf edge markers from a conventional unwinder 12 that roll feeds edge markers in continuous sheet form into a conventional perforator/slitter/cutter 14 that slits and cuts the continuous roll fed sheet of shelf retail edge markers into extended predetermined lengths of, e.g., about 2 feet to 8 feet, or about 4 feet to 5 feet. In examples, each predetermined sheet length is slit into four separate and individual strips and each individual strip is perforated into four different parallel sections to accommodate different in-store requirements. It is understood that the predetermined sheet lengths may be slit into other numbers of separate and individual strips, and that each individual strip may be perforated into other numbers of different parallel sections. While this system feeds roll stock and cuts and perforates the stock, it does not include a system for automatically accumulating and collating in-store shelf edge strips exiting the system.

Figure 4:
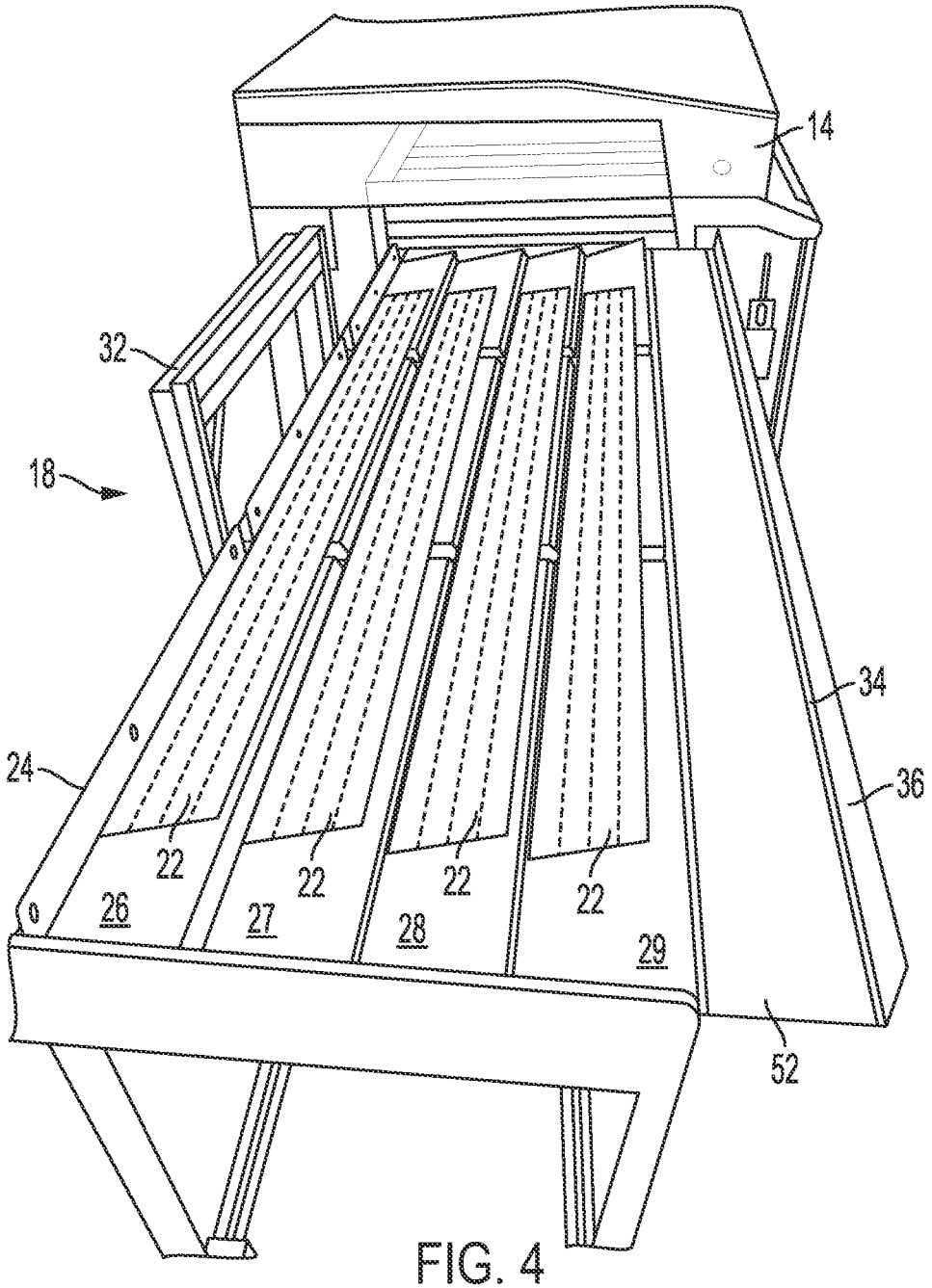
FIG. 4 is a partial end view of the automated packaging system of FIG. 1 showing slit edge marker strips resting therein.

In accordance with the present disclosure, an automated accumulation and collating device 18 of an automated packaging system 20 is depicted in FIG. 1 that fits directly after the perforator/slitter/cutter 14 of the continuous roll feed system 10 and converts the edge markers roll into perforated and cut strips 22 shown in FIG. 4. The automated accumulation and collating device 18 includes a series of angled baffles 24 that may be identical and include bins 26, 27, 28 and 29, more clearly shown in FIG. 2, that accept and register the retail edge marker strips 22 from the perforator/slitter/cutter 14 and accumulates them as they exit perforator/slitter/cutter 14. Each angled baffle 24 is configured to allow retail edge marker strips exiting perforator/slitter/cutter 14 to cascade from the upstream angled baffle eliminating stub points and provides a downward slope towards distal end 38 of the automated accumulation and collating device 18 to help the retail edge marker strips 22 convey down the angled baffles. Bins 26, 27, 28 and 29 of angled baffles 24 are configured to allow the retail edge marker strips 22 to fall into place during the accumulation stage (FIGS. 4 and 11) and then allow the retail edger marker strips to be collated onto a final stack compiling platform 34 after all of the retail edge marker strips have been fed from perforator/slitter/cutter 14. At the end of the accumulation stage, an automated pusher 32 is moved orthogonally to the retail edge marker strips 22 to remove the retail edge marker strips from each bin 26, 27, 28 and 29 onto the top of retail edge marker strips in adjacent bins of baffles 24 in succession to collate the retail edge marker strips onto the final stack platform 34 (FIG. 5), as will be described in greater detail below.

Figure 2:
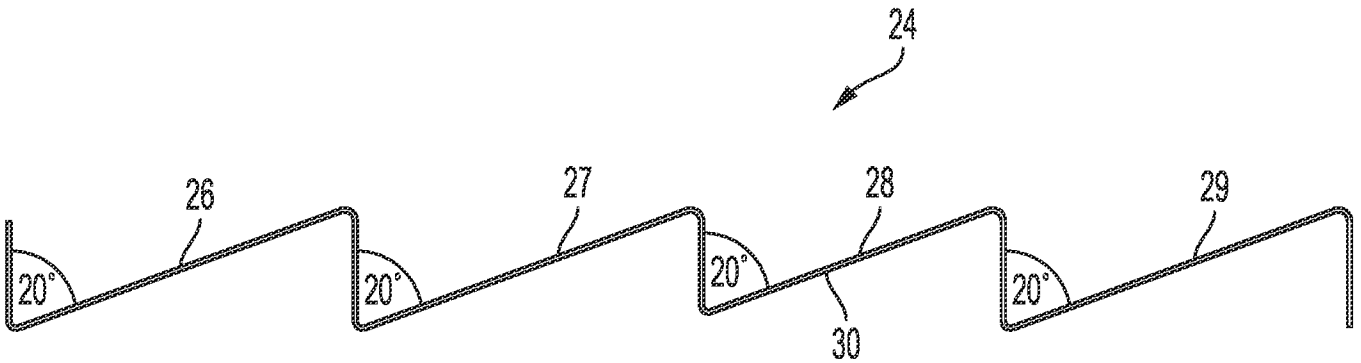
FIG. 2 is a side view of an angled baffle accordance with examples and used in the automated packaging system in FIG. 1.

An exemplary angled baffle 24 is shown in FIG. 2 that includes bin shelves equal in width with the exception of bin shelf 30 which may be shorter or narrower. The shelves of bins 26, 27, 28 and 29 are critically positioned at an angle (e.g., 10°-40°, or approximately 20°) to help facilitate having the retail edge marker strips 22 separate and accumulate in the bins 26-29 automatically by letting the retail edge markers strips drop and slide to the bottom of the respective bins. The bins edges also register longer retail edge marker strips. The narrower shelf 30 is helpful when it is necessary to accommodate different retail edge marker strip widths with the same angled shelve. When starting from the center line of the sheet of retail edge markers this keeps the different width retail edge marker strips 22 in the last bin from overlapping the third bin which would then allow the edge of the last set of retail edge marker strips to get hung up on the tip of the angled shelf when they are being fed in from the upstream perforator/slitter/cutter 14.

Figure 3:
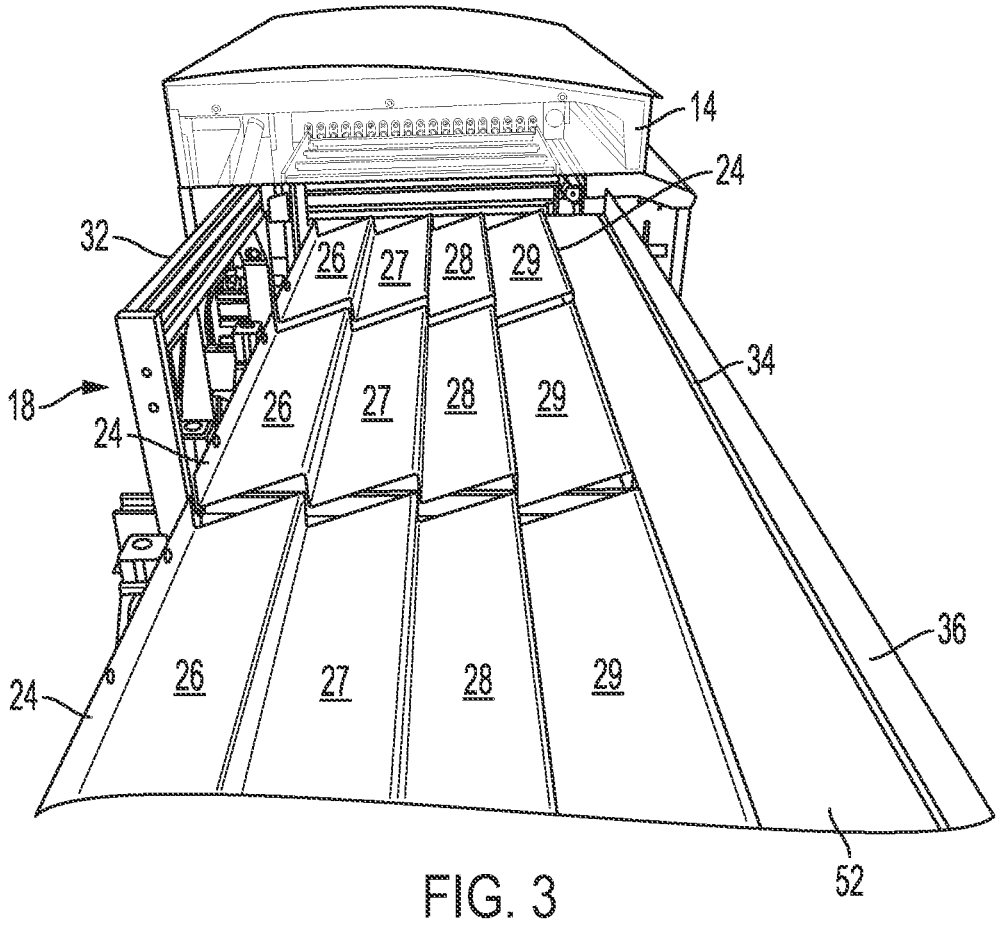
FIG. 3 is a partial end view of the automated packaging system of FIG. 1 showing a series of angled baffles.

As can be seen in FIG. 3, each bin 27, 28 and 29 is stepped downward an increment, as well as staggered backward after bin 26 in order to prevent stubbing of retail edge marker strips on edges of a succeeding bin. In addition, the stepping and staggering of each bin with respect to the preceding one enhances registering long retail edge marker strips exiting the upstream perforator/slitter/cutter 14. Pusher 32 is arranged for automated pulling through openings between bins 24 towards platform 34 to unload retail edge marker strips from each bin and simultaneously convey the retail edge marker strips onto platform 34 at a stacking position thereon laterally across from the angled baffles 24 into a collated stack 48 after all of the retail edge marker strips have been fed from perforator/slitter/cutter 14. The platform 34 may include upstanding longitudinal walls 36 distal the series of angled baffles, with the upstanding longitudinal wall configured to register the retail edge marker strips 22 laterally as the automated pusher 32 urges the marker strips onto the platform 34. The retail edge marker strips 22 abut the upstanding longitudinal wall as the media strips are shifted and compiled at the first position and form a compiled collated stack.

Figure 5:
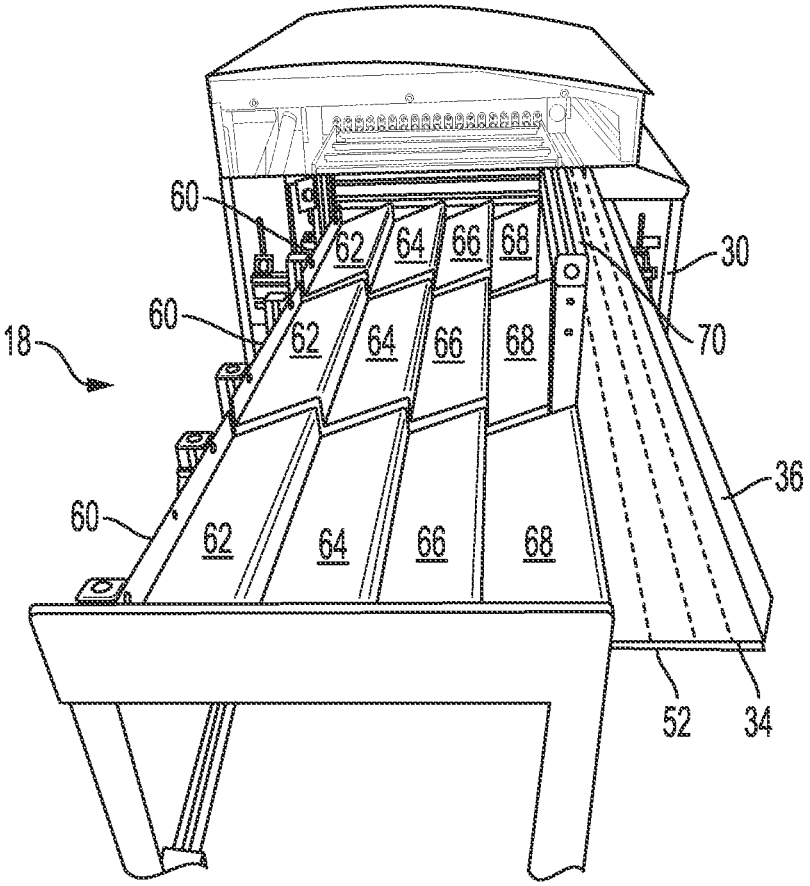
FIG. 5 is a partial end view showing a final bundle of collated edge marker strips in accordance with examples of the embodiments.

Bundles of retail edge marker strips 22 in FIG. 4 are shown in the angled baffles 24 after exiting perforator/slitter/cutter 14 and settling into bins 26-29 ready for a single collation push onto compiling platform 34. Each bundle of retail edge marker strips 22 is made up of four retail edge marker strips separated by a perforation for ease in separating the retail edge marker strips for placement onto store shelf edges. In FIG. 5, a final collated bundle is formed by the automated pusher 32 moving via the pusher drive system 56 in the cross process direction across the angled baffles 24 to stack the separate bundles into a single collated stack 48 and in in-store planogram order.

Figure 7:
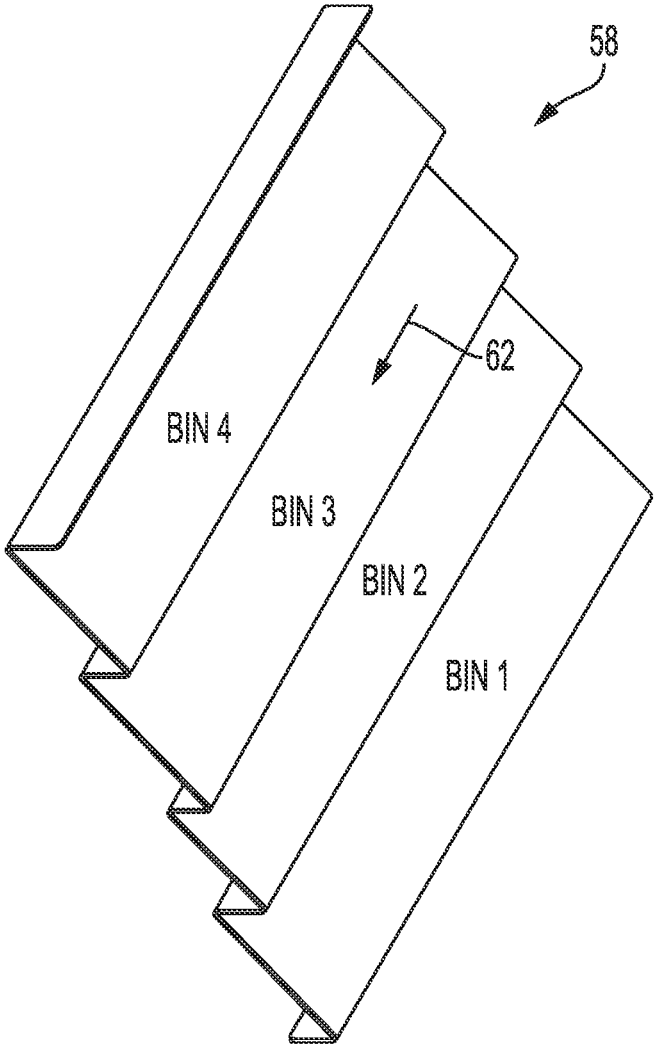
FIG. 7 is a perspective view of a baffle with a kicker bin in accordance with the present disclosure.
Figure 8:
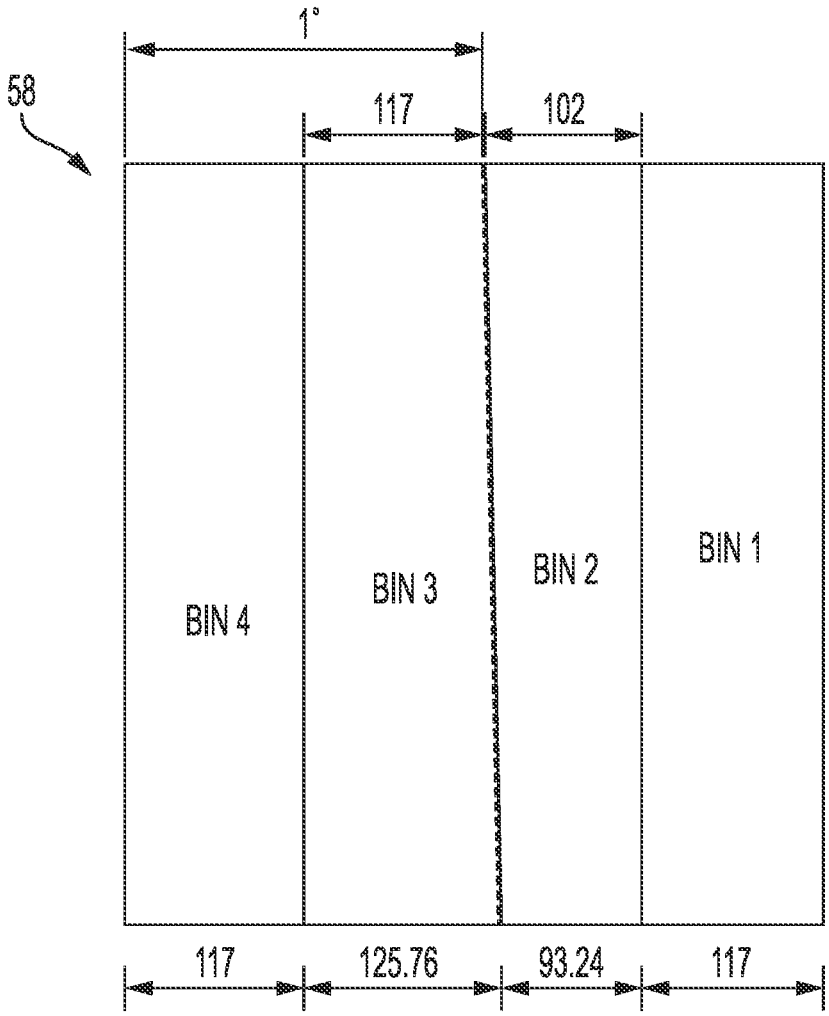
FIG. 8 is a schematic top view of the baffle with the kicker bin shown in FIG. 7.

Another example of the angled baffles is shown in FIGS. 7 and 8 and includes a baffle 58 that is positioned furthest from perforator/slitter 14 and accepts incoming retail edge marker strips 22 conveyed in the direction of arrow 62. Baffle 58 includes a kicker bin 2 that that is the narrowest of the bins 1 through 4 and has an upstanding back portion that is tilted at an angle (e.g., less than 10°, less than 5°, about 1°) with respect to an upstanding portion of bin 3 of about 1° to bump the lead edge of incoming retail edge marker strips. This bump is beneficial as it may assist in separating the trail edge of a bumped retail edge marker strip from a retail edge marker strip entering bin 1. FIG. 8 lists exemplary widths of bins 1 through 4.

It should be understood that an automated accumulation and collating device 18 has been disclosed that collates retail edge markers which have been cut from a high speed continuous feed roll and fall directly into bins of a plurality of one or single piece stepped and angled baffles that drop downward and back from each other consecutively to provide both separation and registration of long media strips (e.g., retail edge marker strips). The stepped and angled baffles are configured to allow the cut media to slide successively from the first of the plurality of stepped and angled baffles to the last angled baffle to eliminate stubbing points and provide a downward slope to ease the conveying of the media strips down the angled baffles. After all of the retail edge markers have settled into respective baffle bins, a cross process collation system is actuated that includes a pusher that is used to orthogonally contact the retail edge markers and empty the first bin contents on top of the contents of the next bin and continue consecutively until all of the retail edge markers are pushed as one bundle onto a compiling or final collation platform for pick-up and distribution to a specific store identified on the edge markers.

Cross process collation of the retail edge markers is performed after each store or job requirement is completed and the cross process collation is critical in that it facilitates compiling of the retail edge markers on the final collation platform in the shortest distance for reduced delay in feeding the retail edge markers to the accumulation, collation and transfer system. Cross process collation of the retail edge markers may also occur intra job, for example, upon a number (e.g., greater than 5, less than 100, between 10 and 50) of retail edge marker strips being deposited onto each bin. This may occur when there are too many edge strips (e.g., more than 20, more than 40, more than 200) to a store that need to be swept in the cross process direction at a time. This may also occur if a store requires retail edge marker strips having different lengths, where strips having the same length may be collated at a time before another length of strips is deposited onto the bins. Thus more than one cross process collations may occur for a store or job requirement.

Figure 6:
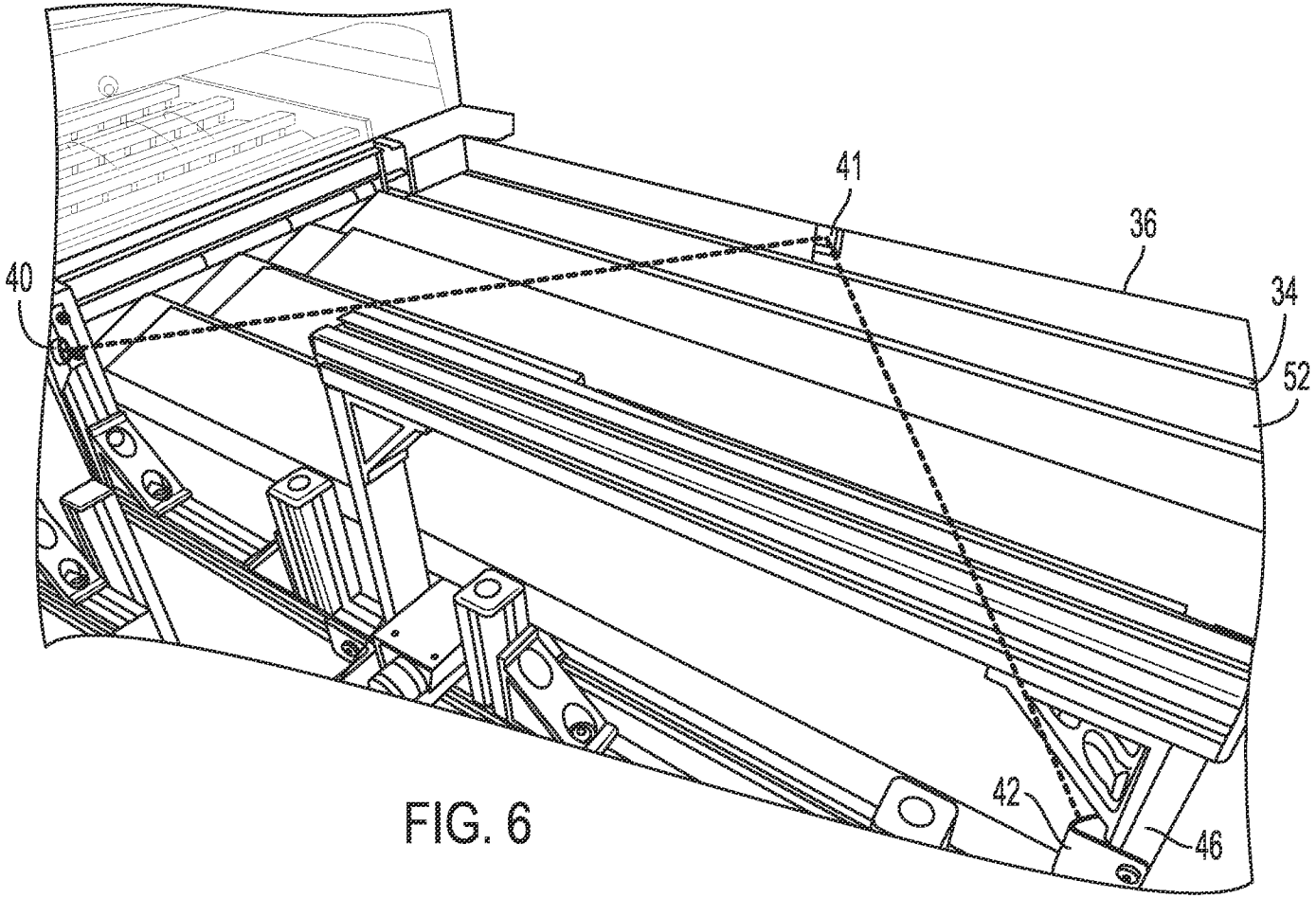
FIG. 6 is a perspective view of a jam detecting sensing system in accordance with the present disclosure.

The automated accumulation and collating device 18 may include a sensing arrangement depicted by example in FIG. 6 that shuts the system down if there is a jam or pileup of retail edge markers in baffles 24. The sensing arrangement may include a dual use retro-reflective sensor 40 (e.g., Banner QS18) that directs a beam into mirror 41 mounted on a wall portion (e.g., of upstanding longitudinal wall 36) connected to the compiling platform 34. The beam reflects off mirror 41 and against a reflector 42 that is mounted on upstanding support member 46 shown in FIG. 6 which assists in supporting automated pusher 32. The beam is then reflected back from reflector 42 to retro-reflective sensor 40. If for any reason the beam is broken, e.g., a jam or misaligned retail edge marker strips, the system 10 will be stopped. Dual use retro-reflective sensor 40 is also used to ensure that pusher 32 is back in the home or start position before giving a stacker ready signal.

Figure 9:
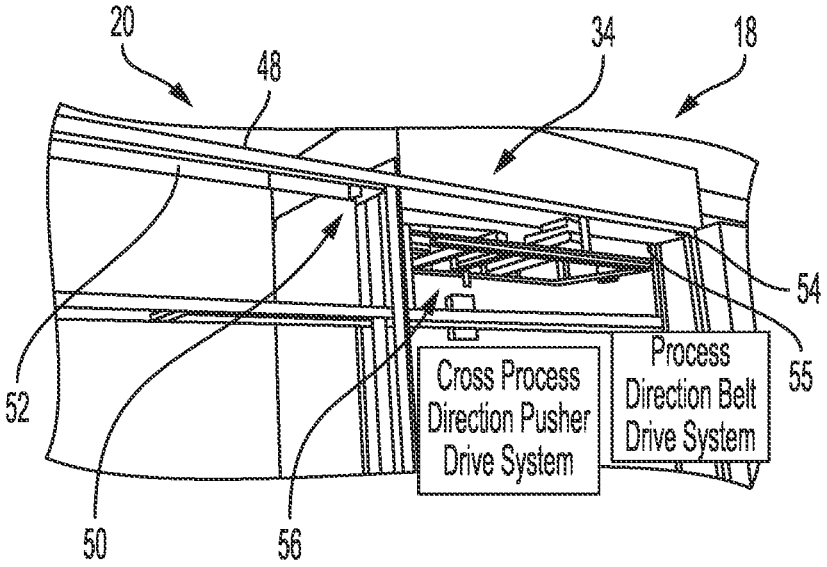
FIG. 9 is a partial perspective view of an automated accumulation and collating device and a transport device in accordance with examples.

FIG. 9 depicts the automated packaging system 20 including the accumulation and collating device 18 and a transport device 50 in bottom perspective view. As noted above, the pusher 32 (FIGS. 4 and 5) is automated to automatically move the retail edge marker strips 22 from the angled baffle 24 onto the platform 34 into a collated stack 48 at the end of the accumulation stage when a batch of the retail edge marker strips 22 that may correspond to a store or part thereof have accumulated in the bins 26-29. In examples the accumulation stage ends when the retail edge marker strips 22 cut and transferred from the perforator/slitter/cutter 14 for a predetermined store, or subset of a store, settle into the bins. The end of an accumulation stage may be detected, for example by a signal from the system 10 to the controller 60 of accumulation stage completion, or after a period of time (e.g., more than a few seconds, between two and 10 seconds) of perforator/slitter/cutter 14 inactivity that may indicate a deliberate pause in media strip production between different batches of the strips. Upon such detection, the pusher 32 may be moved across the angled baffles 24 by a cross process direction pusher drive system 56 that may include at least one motor (e.g., servo motor, stepper motor) that drives the pusher back and forth across the baffles, as understood by a skilled artisan.

By doing the final collation in the cross process direction, the automated accumulation and collating device 18 collects the bin stacks of retail edge marker strips 22 at the compiling platform 34 in a short move cross process direction allowing for a fast collation process and reduces delay in the high speed continuous feed system which can stop and buffer for a few (e.g., about 10, about 5, about 2 or 3) seconds to allow for the compiling of a set of the retail edge marker strips before another set is released onto the emptied angled baffles 24. Collating in the orthogonal direction from the feed direction facilitates collation in that few second interval. While about a five second buffer stop may be preferred, the buffer could be more or less than five seconds and could stop until an operator action is performed rather than for a set time. While not being limited to a particular theory, an optical mark may be included on the edge trim of the last retail edge marker strip of a set that is sensed to signal the system to stop and wait for the orthogonal pusher operation, as understood by a skilled artisan. The depth of the bins allow retail edge markers for an entire store to be accumulated as a set prior to collating into a stack. The retail edge strip markers may also be accumulated and then pushed at predetermined break points, for example, if a store volume is too large of if the process can be improved by using set breakpoints.

Figure 10:
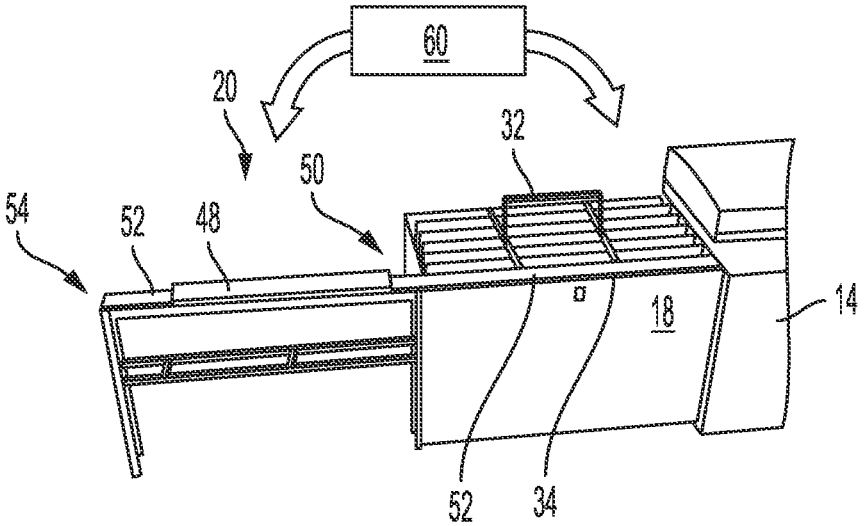
FIG. 10 is a partial perspective view of the automated accumulation and collating device and the transport device shown in FIG. 9.

FIG. 10 depicts an exemplary configuration of the automated packaging system 20 with the platform 34 part of the transport device 50 configured to move the compiled collated stack 48 of retail edge marker strips 22 automatically from the stacking position on the compiling platform 34 to a second position downstream the stacking position, for example, in response to detecting a formation of the compiled collated stack. This detection may occur based on a retreat of the automated pusher 32 from the compiling platform, for example, upon the dual use retro-reflective sensor 40 (FIG. 6) giving a stacker ready signal to the controller 60 based on return of the reflected beam from reflector 42 when the automated pusher 32 has returned back in its home or start position, or upon a motor or pump moving the automated pusher from the compiling platform. The transport device 50 may include a conveyor belt 52 configured to rotate around end rollers 54 and move the collated stack 48 from the stacking position downstream and away from the stacking position, whereupon another collated stack may be formed at the stacking position on the compiling platform 34. Further, the transport device 50 may include at least one motor 55 (e.g., servo motor, stepper motor) or pump that may be attached to the end rollers or other rollers in contact with the conveyor belt 52 to rotate the belt (e.g., counterclockwise in FIGS. 9 and 10) and move the upper side of the belt at the platform 34 downstream in the process direction to move collated stack 48 away from the compiling platform 34, as understood by a skilled artisan. Thus, at the end of the collation stage, that is, after the automated pusher 32 moves orthogonally to the retail edge marker strips 22 to collate the strips into the collated stack 48 on the conveyor belt 52, the belt is incremented with the collated stack in the process direction in a smooth manner that allows the collated strips to remain in the stack.

Figure 11:
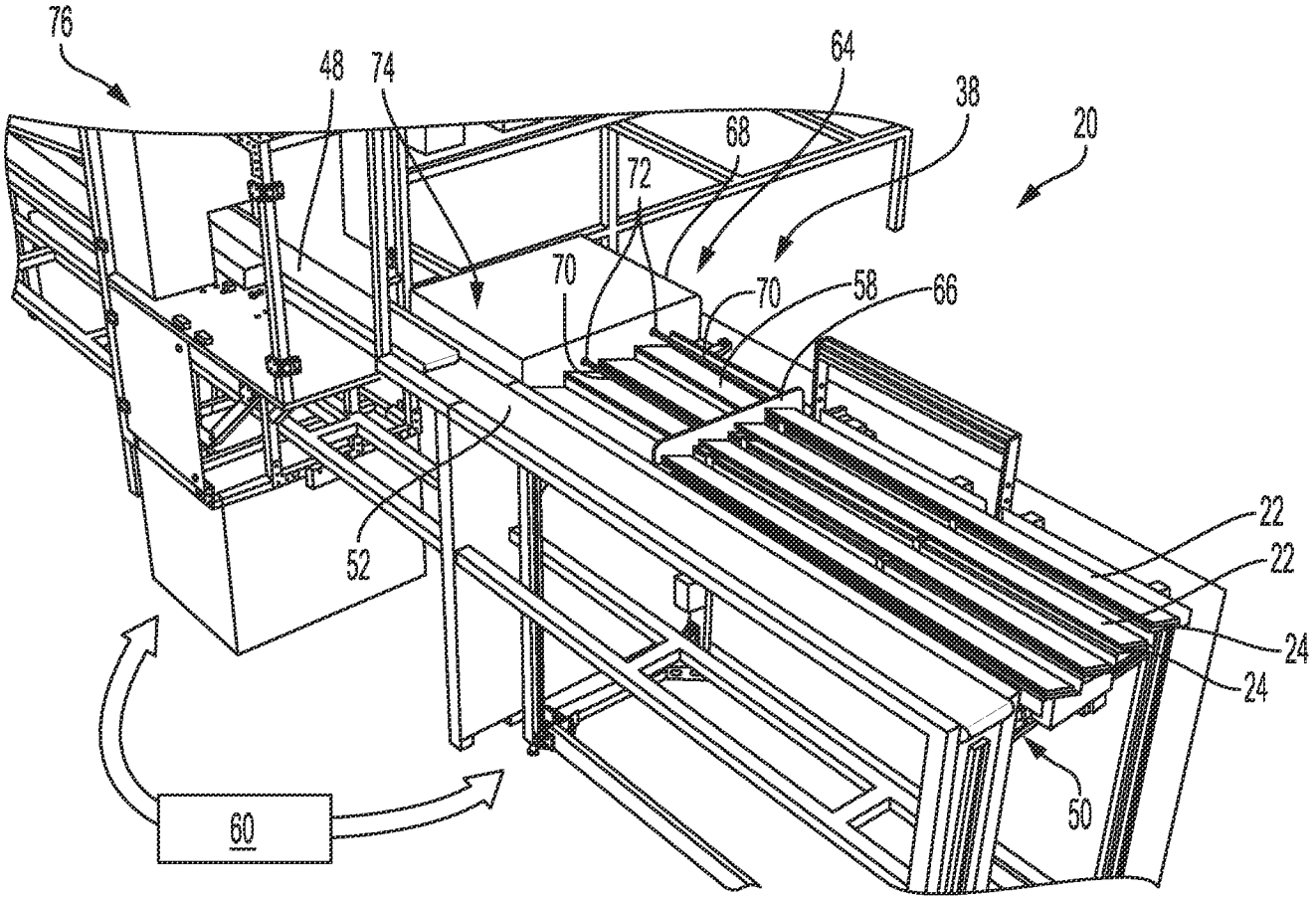
FIG. 11 is a partial perspective view of an automated packaging system including a bander in accordance with examples.

FIG. 11 depicts the automated accumulation and collating device 18 and transport device 50 in prospective view, with retail edge marker strips 22 separated and registered in angled baffles 24. As noted above, the strips 22 may typically have a length of 4 or 5 feet, and are not limited to a particular length. The automated accumulation and collating device 18 may include an alignment device 64 at a distal end of the angled baffles that includes an upright stopper wall 66 that extends laterally across the upper surface of the baffles, for example, baffle 58. The stopper wall 66 stops retail edge marker strips 22 that cascade downstream the angled baffles and longitudinally registers the strips 22 as the accumulate in each bin 26-29. The alignment device 64 may include a housing 68 at the distal end 38 that has components therein configured to move the stopper wall 66 longitudinally along the baffles, for example via rods 70 coupled to the stopper wall. The rods 70 may pass through apertures 72 into the housing 68, and connect to a reciprocating drive system 74 in the housing. The reciprocating drive system 74 may include at least one reciprocating motor (e.g., servo motor, stepper motor) or pump that is attached to the rods 68 and moves the stopper wall 66 back and forth to a desired length of the retail edge marker strips 22, as understood by a skilled artisan. The stopper wall 66 may be adjusted before a batch of retail edge marker strips exits the perforator/slitter/cutter 14 (FIG. 9) automatically before the strips reach the angled baffles 24 or manually, for example, via interaction with a controller 60, as will be discussed in greater detail below.

The alignment device provides a benefit of allowing a particular store's retail edge marker strips 22 having different lengths to be packaged more efficiently in order without having to reconfigure the automated accumulation and collating device 18. Current nonautomated systems must run all 48" edge strips for one size (e.g., 48 inches) and then after the particular size strips are done, or a portion of them are done, an operator has to manually reset the length by putting in or removing a structural end stop to allow for a run of strips having another length (e.g., 60 inches, 35 inches). This forces the operator to put aside completed 48 inch strips in boxes until 60 inch strips are done for each store because the operator typically needs to box up both sized bundles in the same box, the new approach allows the automated packaging system 20 to run one size strips and then automatically run another size strips right after because the automated alignment device 64 adjusts the end stop. So in this example, 48 inch strips can continue on to be banded and put into a box while 60 inch strips are being processed, and then the longer strips can be put into the box on top of the 48 inch strips. In examples, the 60 inch strips may be too long for a shipping box, for example, about 48 inches may be the limit. In such an example, an operators would roll the 60 inch strips and put them in the box. With the automated packaging system 20, 48 inch strips may go into the boxes as discussed for example in greater detail below, and then 60 inch strips may be inserted into the boxes on top of the 48 inch strips, even if the longer strips still stick out for an operator to roll them up. Under this exemplary approach, retail edge marker strips 22 for an entire store can be done without having to batch the stores waiting for different sized strips to be completed.

Still referring to FIG. 11, a collated stack 48 of marker strips 22 is shown being transferred by the conveyor belt 52 from the compiling platform 34 downstream for subsequent packaging and eventual shipment to the store having the in-store planogram order associated with the collated stack. The conveyor belt is shown incremented with the collated strips in the process direction in such a way that allows the collated strips to remain in a stack. This removes the collated stack 48 from the collation area so that a next set of marker strips can be collated onto the transport device conveyor belt at the platform 34 for removal.

Figure 12:
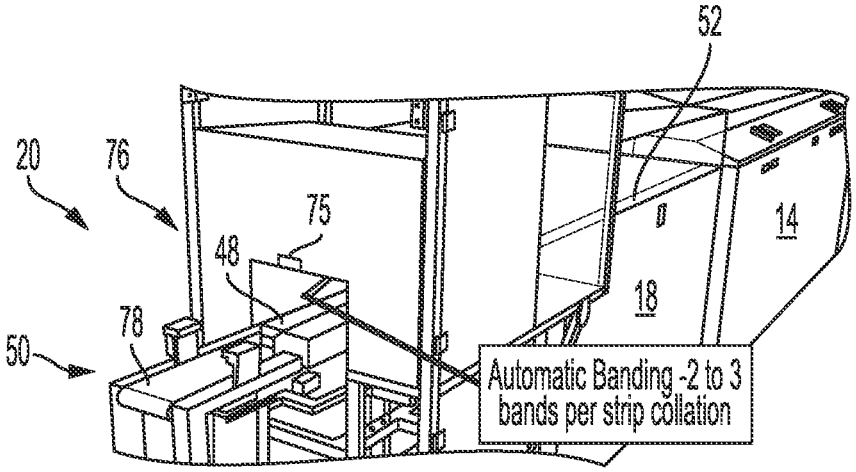
FIG. 12 is a partial perspective view of the bander shown in in FIG. 11.

In examples, the collated stacks 48 may be unloaded from the conveyor belt 52 via automation. Before such unloading, the retail edge marker strips 22 in the collated stack may be bound together for easier handling and transport. FIGS. 11 and 12 depict an exemplary bander 76 (e.g., Madison Bander by Controls Engineering LLC) integrated in-line with the conveyor belt 52 and configured to band the collated stack 48 so that all retail edge marker strips 22 in the stack are held in one block. In examples, the bander 76 may wrap a thin film (e.g., plastic wrap) around the collated stack 48 automatically upon placement of the stack within the bander by the transport device 50, as understood by a skilled artisan. To help facilitate the wrapping, the transport device may include a second conveyor belt 78 (FIG. 12) as a transfer unit in-line with and separated from the conveyor belt 52 to allow a gap (e.g., less than six inches, a few inches) therebetween for the bander to wrap the thin film around all sides of the collated stack without interference from support structure, such as the belts. Such a gap may be required to allow the bander 76 to fully wrap around the collated stack 48 without wrapping around the conveyor belt or displacing the stack above the conveyor belt during wrapping as understood by a skilled artisan. The bander 76 may also include side walls that help to further register the loose retail edge marker strips 22 of the collated stack 48 prior to the banding to minimize the film needed to band the stack. The bander 76 adjacent the transport device 50 may automatically band the compiled collated stack 48 of the media strips into a bounded bundle, for example via a sensor 75 (e.g., camera, imager, light detector) of the bander detecting the stack (e.g., front edge, rear edge, weight, belt travel) located within the bander, and communicating the detection to the controller 60 and/or bander, as understood by a skilled artisan.

The transport device 50 extends beyond the bander 76, with the second conveyor belt 78 as the transfer unit rotatable to automatically move the banded compiled collated stack from the bander downstream for further pre-shipment packaging. In other words, after completion of the banding, the automated packaging system 20, via the controller 60, may direct the transfer unit (e.g., second conveyor belt) to move the banded collated stack from the bander. In examples, the transport device 50, via the second conveyor belt 78 or conveyor belt 52 if no bander 76 or gap is needed, may move the banded collated stack 48 into a shipping container 100. FIGS. 13-16 depict exemplary shipping container loaders adjacent the transport device that is configured to position a shipping container 100 (e.g., box, cardboard box) proximate the transport device 50 for receipt of a compiled collated stack 48 therein. Such loaders may also automatically move the shipping container 100 away from the transport device 50 upon receipt of the collated stack 48, or a number of collated stacks as desired for shipment to a store. For example, the loaders may include a sensor (e.g., scanner, weight scale) configured to detect when a shipping container 100 has received all collated stacks intended to be shipped together.

Figure 13:
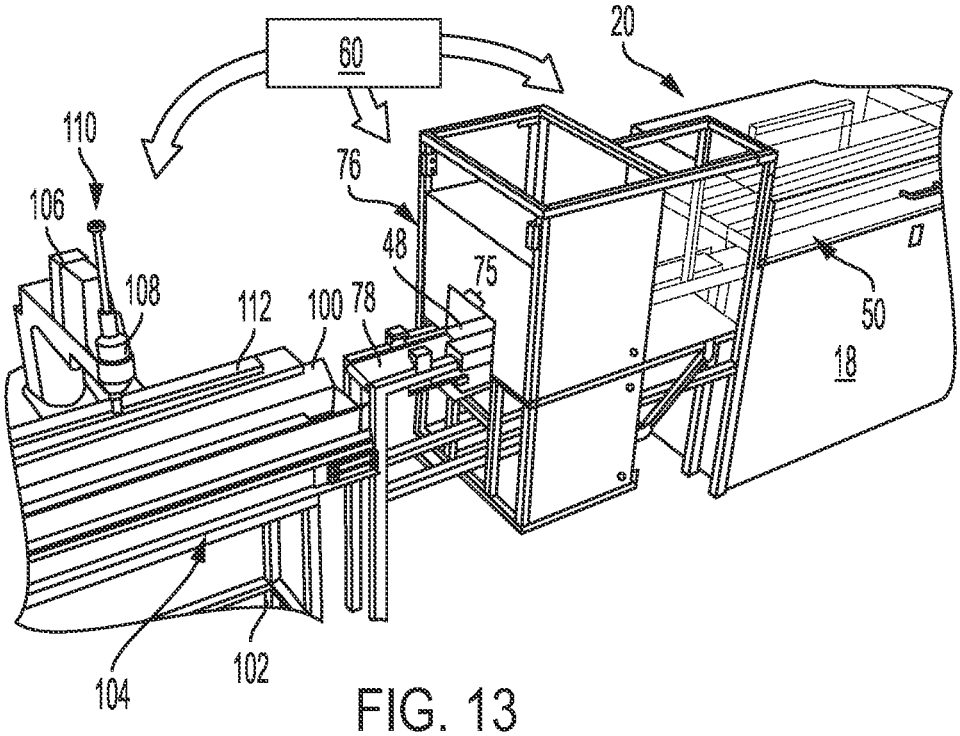
FIG. 13 is a partial perspective view of an automated packaging system including a bander and a shipping container loader system in accordance with examples.

FIG. 13 depicts the automated packaging system 20 having a shipping container loader system 110 that includes a box stand 102 with a conveyor device 104 (e.g., conveyor belt, rollers) configured to allow a container 100 to move downstream in the process direction upon receipt of collated stacks 48. The loader system 110 may also include a robotic device 106 that may pick up a collated stack 48 and move the stack into a container proximate the robotic device. The robotic device 106 includes an arm 108 that may extend, rotate and otherwise move a pneumatic end effector 112 or other type of clamp configured to pick up a collated stack (e.g., via suction, friction, sub-stack support) and move the stack as desired over an opening of the container 100 and release the stack into the container. As can be seen in FIG. 13, the robotic device 106 may be superfluous in this example when the box stand 102 and shipping container 100 are lower than the second conveyor belt height. As the second conveyer belt 78 rotates, it moves collated stack 48 into the container. Upon exit from the second conveyer belt 78, the collated stack may drop completely into the shipping container. Once filled with the collated stack 48 or stacks as desired for shipment to a store, the container 100 may be moved further away from the transport device 50 to allow placement of an empty container for receipt of another stack.

Figure 14:
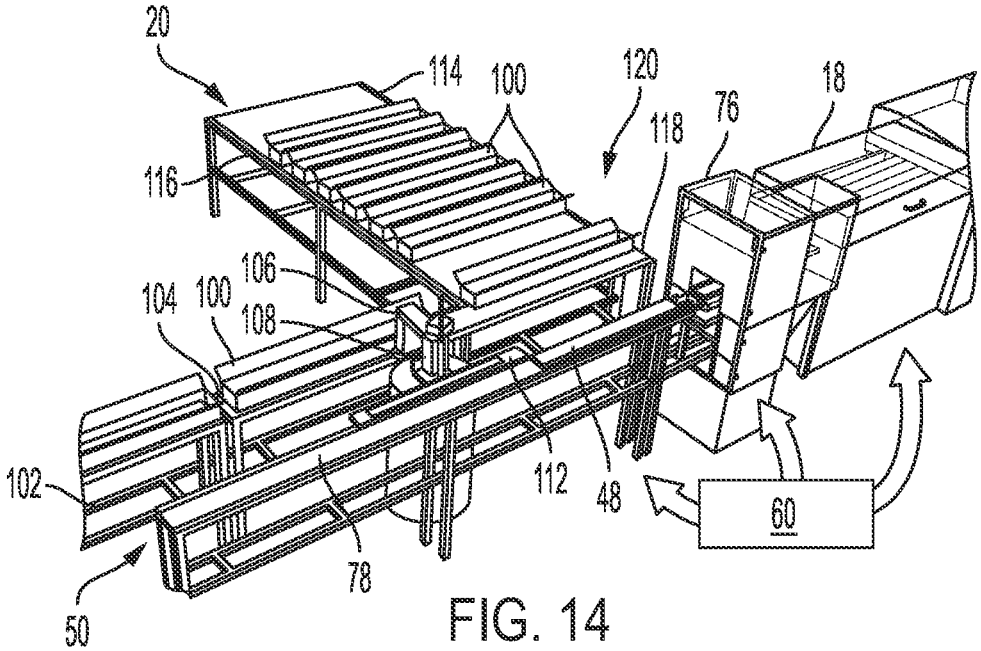
FIG. 14 is a partial perspective view of an automated packaging system including a bander and another shipping container loader system in accordance with examples.

FIG. 14 depicts another loader system 120 of the automated packaging system 20 that includes a box stand 102 and conveyor device 104 in an offset position opposite the robotic device 106, and the transport device 50 extending in-line further beyond the bander 76 with the second conveyor belt 78 extending past the robotic device. The box stand 102 may include a plurality of conveyor device 104 (e.g., conveyor belt, rollers) configured to place an empty container in position to receive collated stacks 48 from the robotic device 106 and then remove the filled container for further processing (e.g., closing the filled container, labeling and shipment). For example, a first box conveyor belt 114 on table 116 is configured to move empty containers 100 laterally towards a second box conveyor belt 118 that is configured to move containers longitudinally past the robotic device 106 for receipt of collated stacks 48 and exit away from the robotic device. The robotic device arm 108 moves the pneumatic end effector 112 or other type of clamp to pick up a collated stack (e.g., via suction, friction, sub-stack support) from the second conveyor belt 78 and move the stack as desired to the opposite side of the robotic device 106 and over an opening of a shipping container 100 for release of the stack into the container. Once filled with the collated stack 48 or stacks as desired for shipment to a store, the container 100 may be moved further away from the transport device 50 (e.g., via the second box conveyor belt 118 to allow placement of an empty container for receipt of another stack.

Figure 15:
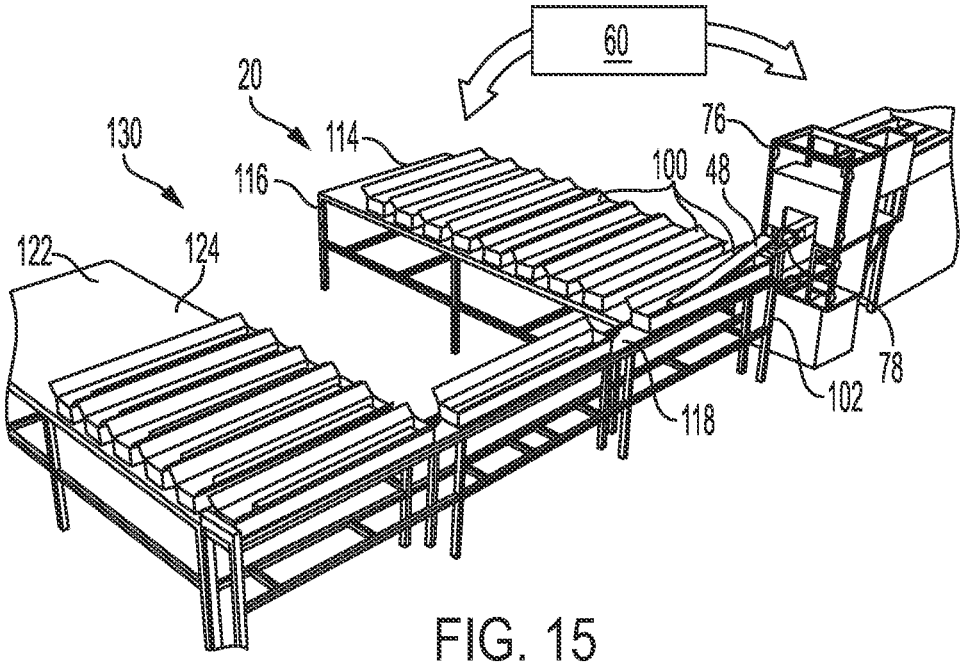
FIG. 15 is a partial perspective view of an automated packaging system including a bander and yet another shipping container loader system in accordance with examples.
Figure 16:
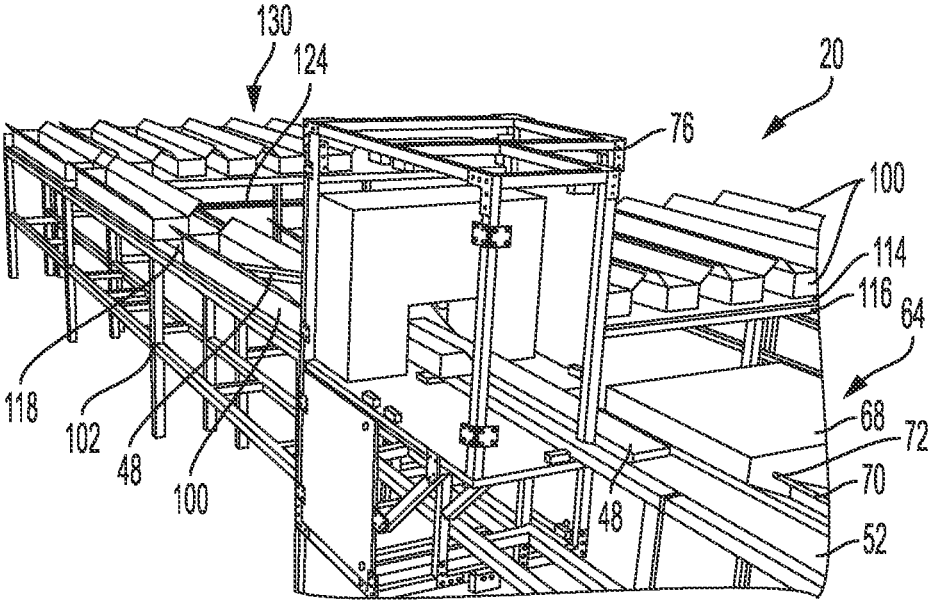
FIG. 16 is a partial perspective view of the bander and shipping container loader system shown in FIG. 15.

FIGS. 15-16 depict yet another loader system 130 of the automated packaging system 20 that is configured to position a shipping container 100 (e.g., box, cardboard box) proximate the transport device 50 for receipt of a compiled collated stack 48 therein, and then to move the filled container away for subsequent processing (e.g., closing the filled container, labeling and shipment). The loader system 130 does not need to use a robotic device, and uses gravity as also described above with the second conveyor belt 78 higher than an open container 100 on the box stand 102.

The box stand 102 may include a plurality of conveyor devices 104 (e.g., conveyor belt, rollers) configured to move an empty container in position to receive collated stacks 48 from the second conveyor belt 78 and then remove the filled container for further processing (e.g., closing the filled container, labeling and shipment). The first box conveyor belt 114 on table 116 is configured to move empty containers 100 laterally towards the container filling location on the second box conveyor belt 118 proximate and lower than the second conveyor belt 78. As the second conveyer belt 78 rotates, it moves collated stack 48 into the container. Upon exit from the second conveyer belt 78, the collated stack drops into the shipping container. The second box conveyer belt 118 may rotate and move filled containers away from the second conveyer belt 78, whereupon an empty container may be shifted by the first box conveyer belt 114 for receipt of collated stacks 48. The loader system may include a third box conveyer belt 122 on table 124 that is configured to move the filled boxes further away from the second conveyer belt 78 as needed for subsequent packaging and eventual shipment to the store having the in-store planogram order associated with the collated stack.

Figure 17:
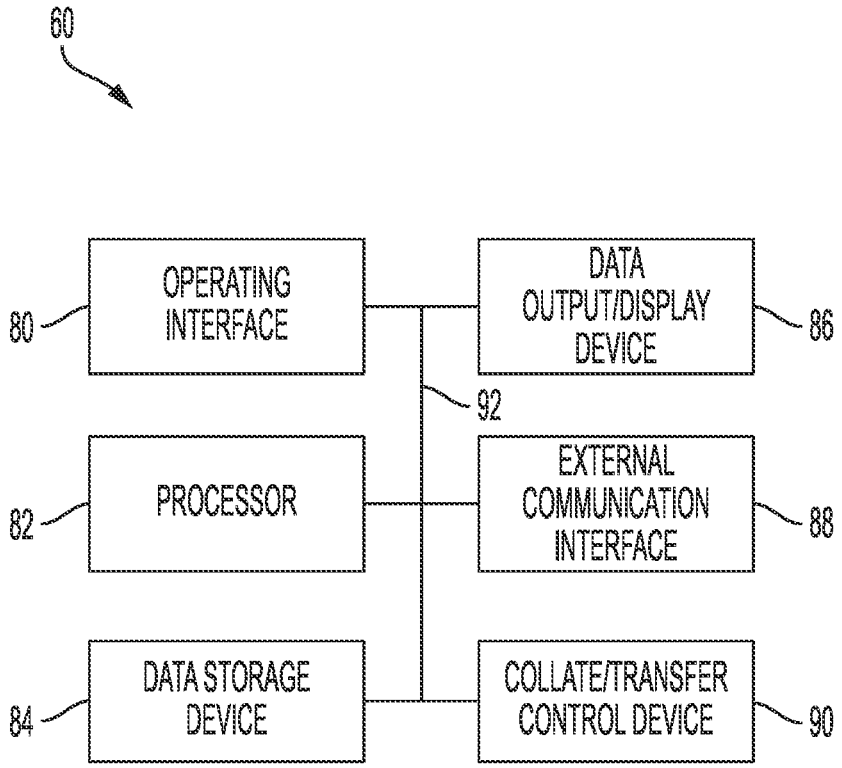
FIG. 17 is a block diagram of a controller for executing instructions to control the automated packaging system.

FIG. 17 illustrates a block diagram of the controller 60 for executing instructions to automatically control the automated packaging system 20 and components thereof. The exemplary controller 60 may provide input to or be a component of a controller for executing the packaging method for automatically collating and transferring media strips including controlling the retail edge marker strip accumulation, collating and transfer in a system such as that depicted in FIGS. 1, 4, 5 and 9-16, and described in greater detail below.

The exemplary controller 60 may include an operating interface 80 by which a user may communicate with the exemplary control system. The operating interface 80 may be a locally-accessible user interface associated with the automated packaging system 20. The operating interface 80 may be configured as one or more conventional mechanism common to controllers and/or computing devices that may permit a user to input information to the exemplary controller 60. The operating interface 80 may include, for example, a conventional keyboard, a touchscreen with "soft" buttons or with various components for use with a compatible stylus, a microphone by which a user may provide oral commands to the exemplary controller 60 to be "translated" by a voice recognition program, or other like device by which a user may communicate specific operating instructions to the exemplary controller. The operating interface 80 may be a part or a function of a graphical user interface (GUI) mounted on, integral to, or associated with, the automated packaging system 20 and/or system 10 with which the exemplary controller 60 is associated.

The exemplary controller 60 may include one or more local processors 82 for individually operating the exemplary controller 60 and for carrying into effect control and operating functions for automated packaging of retail edge marker strips 22 for distribution to associated retail stores, including accumulating the strips onto baffles 24, collating the accumulated strips into collated stacks 48, and/or transferring the collated stacks into containers for transport to the retail stores. For example, in real-time upon receipt of media strips (e.g., retail edge marker strips) exiting an upstream source, processors 82 may trigger an automated pusher to shift the media strips in collated form to a compiling platform 34 and into a compiled collated stack 48 in store planogram order, and then move the collated stack for subsequent packaging and shipment as needed to the associated retail store. Processor(s) 82 may include at least one conventional processor or microprocessor that interprets and executes instructions to direct specific functioning of the exemplary controller 60, and control media strip packaging with the exemplary controller.

The exemplary controller 60 may include one or more data storage devices 84. Such data storage device(s) 84 may be used to store data or operating programs to be used by the exemplary controller 60, and specifically the processor(s) 82. Data storage device(s) 84 may be used to store information regarding, for example, media strip status information, media strip accumulation information, media strip compilation information, media strip stack information, location information of the media strip stacks, and other packing information with which the automated packaging system 20 is associated. Stored media strip and stack data may be devolved into data to generate a recurring, continuous or automated packaging system in the manner generally described by examples herein.

The data storage device(s) 84 may include a random access memory (RAM) or another type of dynamic storage device that is capable of storing updatable database information, and for separately storing instructions for execution of media strip packaging by, for example, processor(s) 82. For example, a data storage device 84 may be coupled to the processor 82, and may include instructions which when executed by the processor, cause the processor to direct the automated pusher 32 to move in the cross process direction to the media strips after the media strips have settled into the bins to shift the media strips in collated form from the bins into the compiled collated stack at a first position (e.g., compiling platform 34) and direct the transport device 50 to move the compiled collated stack of the media strips from the first position downstream for further processing. Data storage device(s) 84 may also include a read-only memory (ROM), which may include a conventional ROM device or another type of static storage device that stores static information and instructions for processor(s) 82. Further, the data storage device(s) 84 may be integral to the exemplary controller 60, or may be provided external to, and in wired or wireless communication with, the exemplary controller 60, including as cloud-based data storage components.

The data storage device(s) 84 may include non-transitory machine-readable storage medium used to store the device queue manager logic persistently. While a non-transitory machine-readable storage medium is may be discussed as a single medium, the term "machine-readable storage medium" should be taken to include a single medium or multiple media (e.g., a centralized or distributed database, and/or associated caches and servers) that store one or more sets of instructions. The term "machine-readable storage medium" shall also be taken to include any medium that is capable of storing or encoding a set of instruction for execution by the controller 60 and that causes the automated packaging system 20 to perform any one or more of the methodologies of the present invention. The term "machine-readable storage medium" shall accordingly be taken to include, but not be limited to, solid-state memories, and optical and magnetic media.

The exemplary controller 60 may include at least one data output/display device 86, which may be configured as one or more conventional mechanisms that output information to a user, including, but not limited to, a display screen on a GUI of the automated packaging system 20 or associated system 10 device with which the exemplary controller 60 may be associated. The data output/display device 86 may be used to indicate to a user a status of the automated packaging system 20 with which the exemplary controller 60 may be associated including an operation of one or more individually controlled components at one or more of a plurality of separate packaging stations or subsystems associated with the automated packaging system, including but not limited to the automated accumulation and collating device 18, the transport device 50, the pusher drive system 56, the alignment device 64, the reciprocating drive system 74, the bander 76, the conveyor device 104, the robotic device 106, and the shipping container loader systems 110, 120, 130.

The exemplary controller 60 may include one or more separate external communication interfaces 88 by which the exemplary controller 60 may communicate with components that may be external to the exemplary control system such as the unwinder 12 and perforator/slitter/cutter 14. At least one of the external communication interfaces 88 may be configured as an input port to support connecting an external CAD/CAM device storing modeling information for execution of the control functions in the media strip packaging operations. Any suitable data connection to provide wired or wireless communication between the exemplary controller 60 and external and/or associated components is contemplated to be encompassed by the depicted external communication interface 88.

The exemplary controller 60 may include a collate/transfer control device 90 that may be used to control a media strip packaging process including media strip accumulation, collating, transfer, and loading into shipping containers. The collate/transfer control device 90 may operate as a part or a function of the processor 82 coupled to one or more of the data storage devices 84 and the automated packaging system 20, or may operate as a separate stand-alone component module or circuit in the exemplary controller 60.

All of the various components of the exemplary controller 60, as depicted in FIG. 17, may be connected internally, and to the automated packaging system 20, associated media strip formation and packaging devices upstream or downstream the automated packaging system and/or components thereof, by one or more data/control busses 92. These data/control busses 92 may provide wired or wireless communication between the various components of the automated packaging system 20 and any associated media strip formation and packaging devices, whether all of those components are housed integrally in, or are otherwise external and connected to automated packaging system with which the exemplary controller 60 may be associated.

It should be appreciated that, although depicted in FIG. 17 as an integral unit, the various disclosed elements of the exemplary controller 60 may be arranged in any combination of subsystems as individual components or combinations of components, integral to a single unit, or external to, and in wired or wireless communication with the single unit of the exemplary control system. In other words, no specific configuration as an integral unit or as a support unit is to be implied by the depiction in FIG. 17. Further, although depicted as individual units for ease of understanding of the details provided in this disclosure regarding the exemplary controller 60, it should be understood that the described functions of any of the individually-depicted components, and particularly each of the depicted control devices, may be undertaken, for example, by one or more processors 82 connected to, and in communication with, one or more data storage device(s) 84.

Figure 18:
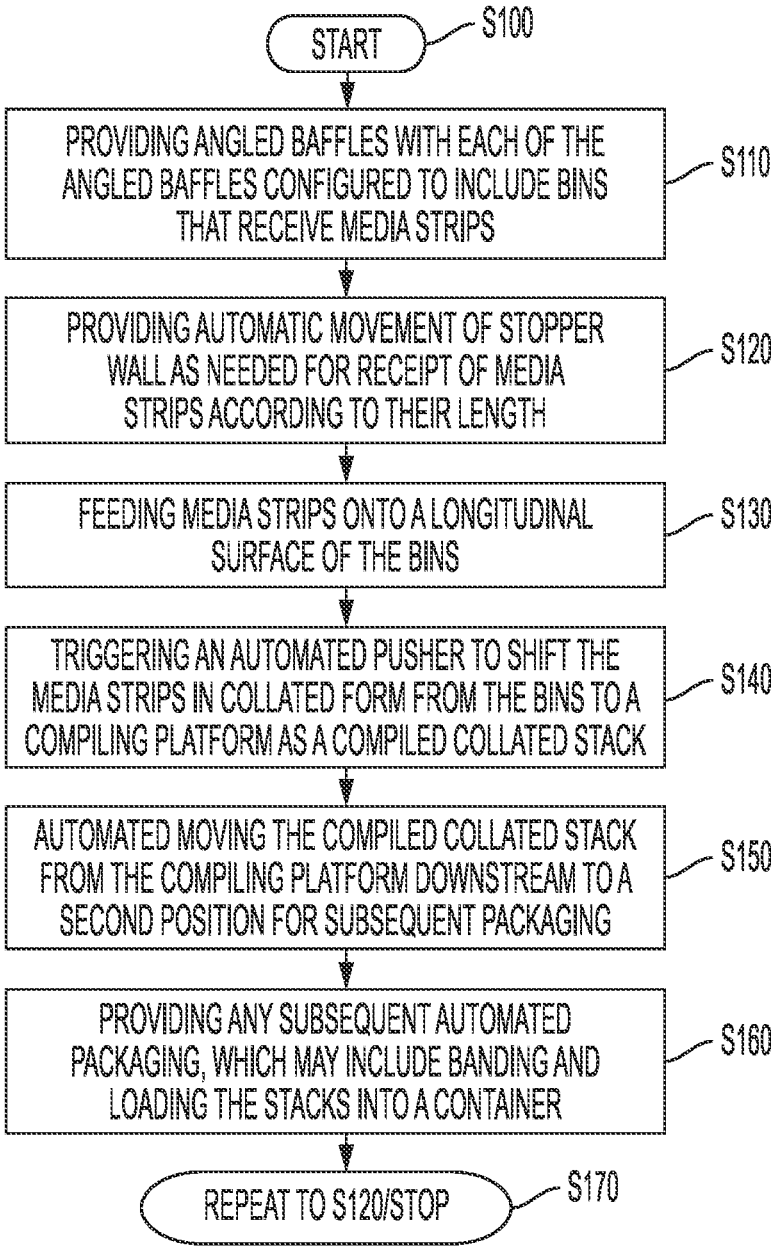
FIG. 18 is a flowchart depicting the operation of an exemplary automated packaging system.

The disclosed embodiments may include an exemplary method for automated accumulation, collating, transfer and packaging of media strips and strip stacks in an automated packaging system 20. FIG. 18 illustrates a flowchart of such an exemplary method. As shown in FIG. 18, operation of the method commences at Step S100 and proceeds to Step S110.

At Step S110, an accumulation and collating device provides a plurality of angled baffles with each of the plurality of angled baffles configured to include bins that receive the media strips with each of the media strips extending over at least two of the plurality of angled baffles. Operation of the method proceeds to Step S120, where an automated alignment device provides automatic movement of the stopper wall as needed for receipt of the media strips according to their length. At Step S130, an upstream source feeds the media strips onto a longitudinal surface of the bins. In examples, the series of baffles includes an upstream angled baffle with each of the remainder of the plurality of baffles configured to cascade from the upstream baffle to eliminate media strip stub points while simultaneously providing a downward slope to enhance media strip sliding down the plurality of baffles.

Operation proceeds to Step S140, where after the media strips have settled into the bins, the controller 60 triggers an automated pusher for automatic movement orthogonally to the bins to shift the media strips in collated form from the bins to a first position at a compiling platform and into a compiled collated stack in store planogram order. Operation proceeds to Step S150, where in response to detecting a formation of the compiled collated stack, a transport device moves the compiled collated stack of the media strips from the first position at the compiling platform to a second position downstream the first position for subsequent packaging of the compiled collated stack.

Operation proceeds to Step S160 for such subsequent packaging of the compiled collated stacks. In examples, subsequent packaging may include a banding unit adjacent the transport device may automatically band the compiled collated stack of the media strips into a bounded bundle. If certain examples, subsequent packaging may include a transfer unit adjacent the transport device may automatically move the compiled collated stack from the second position into a shipping container. Subsequent packaging may include a shipping container loader that positions shipping container proximate the transfer unit for receipt of the compiled collated stack therein, and to automatically move the shipping container away from the transfer unit once the shipping container has received the compiled collated stack therein. Operation may cease at Step S170, or may continue by repeating back to Step S120 for automatic stopper wall adjustment as needed if the next batch of media strips has a different size than the last batch, and for further media strip accumulation and collating.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 18, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of packaging elements common to automated packaging systems in many different configurations. For example, although automated packaging systems and methods are shown in the discussed embodiments, the examples may apply to other types of media strip processing systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A system for automatically collating and transferring media strips exiting an upstream source, comprising:

a series of angled baffles with each of the series of angled baffles configured to include bins that receive the media strips longitudinally with each of the media strips extending over at least two of the series of angled baffles;

wherein the series of angled baffles includes an upstream angled baffle with each of the remainder of the series of angled baffles configured to cascade from the upstream angled baffle to eliminate media strip stub points while simultaneously providing a downward slope to enhance media strips sliding down the series of angled baffles;

an automated pusher configured for automatic movement in a cross process direction to the media strips in response to detecting that the media strips have settled into the bins to shift the media strips in collated form from the bins to a first position and into a compiled collated stack in store planogram order; and a transport device configured to move the compiled collated stack of the media strips automatically from the first position to a second position downstream the first position in response to detecting a formation of the compiled collated stack for subsequent packaging of the compiled collated stack.

2. The system of claim 1, further comprising a banding unit adjacent the transport device, the banding unit configured to automatically band the compiled collated stack of the media strips into a bounded bundle.

3. The system of claim 1, further comprising a transfer unit adjacent the transport device, the transfer unit configured to automatically move the compiled collated stack from the second position into a shipping container.

4. The system of claim 3, further comprising a shipping container loader adjacent the transfer unit, the shipping container loader configured to position the shipping container proximate the transfer unit for receipt of the compiled collated stack therein, and to automatically move the shipping container distal the transfer unit in response to detecting that the shipping container has received the compiled collated stack therein.

5. The system of claim 3, the transfer unit including a robotic end effector configured to lift the compiled collated stack from the second position and to release the compiled collated stack into the shipping container.

6. The system of claim 1, wherein the series of angled baffles includes a downstream angled baffle, the system further comprising an alignment device at a distal end of the downstream angled baffle, the alignment device including an upright stopper wall extending across the downstream angled baffle in the cross process direction, the upright stopper wall configured to move with or against the process direction automatically before the media strips reach the downstream angled baffle and register the media strips longitudinally with the media strips abutting the upright stopper wall as the media strips settle into the bins.

7. The system of claim 1, further comprising a stack platform at the first position laterally adjacent the series of angled baffles in the cross process direction, the stack platform configured to receive and support the compiled collated stack.

8. The system of claim 7, the stack platform including an upstanding longitudinal wall distal the series of angled baffles, the upstanding longitudinal wall configured to register the media strips laterally with the media strips abutting the upstanding longitudinal wall as the media strips are shifted in the collated form at the first position and form the compiled collated stack.

9. The system of claim 1, further comprising:

a processor in communication with the automated pusher and the transport device; and a storage device coupled to the processor, wherein the storage device includes instructions which, when executed by the processor, cause the processor to direct the automated pusher to move in the cross process direction to the media strips after the media strips have settled into the bins to shift the media strips in collated form from the bins into the compiled collated stack at the first position and direct the transport device to move the compiled collated stack of the media strips from the first position to the second position.

10. A method for automatically collating and transferring media strips exiting an upstream source, comprising:

providing a plurality of angled baffles with each of the plurality of angled baffles configured to include bins that receive the media strips with each of the media strips extending over at least two of the plurality of angled baffles;

feeding the media strips onto a longitudinal surface of the bins from the upstream source;

wherein the series of angled baffles includes an upstream angled baffle with each of the remainder of the plurality of angled baffles configured to cascade from the upstream angled baffle to eliminate media strip stub points while simultaneously providing a downward slope to enhance media strip sliding down the plurality of angled baffles; and providing an automated pusher configured for automatic movement orthogonally to the bins in response to detecting that the media strips have settled into the bins to shift the media strips in collated form from the bins to a first position and into a compiled collated stack in store planogram order; and providing a transport device configured to move the compiled collated stack of the media strips automatically from the first position to a second position downstream the first position in response to detecting a formation of the compiled collated stack for subsequent packaging of the compiled collated stack.

11. The method of claim 10, the subsequent packaging of the compiled collated stack including providing a banding unit adjacent the transport device, the banding unit configured to automatically band the compiled collated stack of the media strips into a bounded bundle.

12. The method of claim 10, the subsequent packaging of the compiled collated stack including providing a transfer unit adjacent the transport device, the transfer unit configured to automatically move the compiled collated stack from the second position into a shipping container.

13. The method of claim 12, the subsequent packaging of the compiled collated stack further including providing a shipping container loader adjacent the transfer unit, the shipping container loader configured to position the shipping container proximate the transfer unit for receipt of the compiled collated stack therein, and to automatically move the shipping container distal the transfer unit in response to detecting that the shipping container has received the compiled collated stack therein.

14. The method of claim 12, the transfer unit including a robotic end effector configured to lift the compiled collated stack from the second position and to release the compiled collated stack into the shipping container.

15. The method of claim 10, wherein the series of angled baffles includes a downstream angled baffle, the method further comprising providing an alignment device at a distal end of the downstream angled baffle, the alignment device including an upright stopper wall extending across the downstream angled baffle in the cross process direction, the upright stopper wall configured to move with or against the process direction automatically before the media strips reach the downstream angled baffle and register the media strips longitudinally with the media strips abutting the upright stopper wall as the media strips settle into the bins.

16. The method of claim 10, further comprising providing a stack platform at the first position laterally adjacent the series of angled baffles in the cross process direction, the stack platform configured to receive and support the compiled collated stack.

17. The method of claim 16, further comprising providing an upstanding longitudinal wall on the stack platform distal the series of angled baffles, the upstanding longitudinal wall configured to register the media strips laterally with the media strips abutting the upstanding longitudinal wall as the media strips are shifted in the collated form at the first position and form the compiled collated stack.

18. The method of claim 10, further comprising:

providing a processor in communication with the automated pusher and the transport device; and providing a storage device coupled to the processor, wherein the storage device includes instructions which, when executed by the processor, cause the processor to direct the automated pusher to move in the cross process direction to the media strips after the media strips have settled into the bins to shift the media strips in collated form from the bins into the compiled collated stack at the first position and direct the transport device to move the compiled collated stack of the media strips from the first position to the second position.

19. A device for automatically collating and transferring media strips exiting an upstream source, comprising:

a series of angled baffles with each of the series of angled baffles configured to include a bin that receive the media strips longitudinally, the series of angled baffles including a downstream angled baffle;

an alignment device at a distal end of the downstream angled baffle, the alignment device including an upright stopper wall extending across the downstream angled baffle in the cross process direction, the upright stopper wall configured to move with or against the process direction automatically before the media strips reach the downstream angled baffle and register the media strips longitudinally with the media strips abutting the upright stopper wall as the media strips settle into the bins;

a stack platform laterally adjacent the series of angled baffles in the cross process direction;

an automated pusher configured for automatic movement in a cross process direction to the media strips in response to detecting that the media strips have settled into the bins to shift the media strips in collated form from the bins to a first position and into a compiled collated stack in store planogram order; and a transport device configured to move the compiled collated stack of the media strips automatically from the first position to a second position downstream the first position in response to detecting a formation of the compiled collated stack for subsequent packaging of the compiled collated stack.

20. The device of claim 1, further comprising a banding unit at the second position, the banding unit configured to automatically band the compiled collated stack of the media strips into a bounded bundle, and a transfer unit downstream the banding unit, the transfer unit configured to automatically move the bounded bundle from the second position into a shipping container.

* * * * *